US006557751B2

(12) United States Patent
Puerini

(10) Patent No.: US 6,557,751 B2
(45) Date of Patent: May 6, 2003

(54) RECYCLABLE BEVERAGE CONTAINER HANDLE

(76) Inventor: Russell Anthony Puerini, 55 Beach View Ter., Middletown, RI (US) 02842

( * ) Notice: Subject to any disclaimer, the term of this patent is extended or adjusted under 35 U.S.C. 154(b) by 0 days.

(21) Appl. No.: 09/878,957

(22) Filed: Jun. 12, 2001

(65) Prior Publication Data

US 2002/0185496 A1 Dec. 12, 2002

(51) Int. Cl.[7] ..... B65D 3/28

(52) U.S. Cl. ..... 229/402; 220/738; 229/117.19; 229/117.23

(58) Field of Search ..... 229/117.19, 117.23, 229/402; 220/737, 738, 758, 759

(56) References Cited

U.S. PATENT DOCUMENTS 1,866,805 A * 7/1932 Haywood ..... 220/737
1,999,878 A * 4/1935 Bombard ..... 229/402
2,194,898 A * 3/1940 Hanford ..... 229/402
2,289,964 A * 7/1942 Hanford ..... 229/117.19
2,558,287 A * 6/1951 Amberg ..... 229/402
2,936,927 A * 5/1960 Peters ..... 229/117.23
2,965,281 A * 12/1960 Herrmann ..... 220/737
3,250,562 A * 5/1966 Frasure et al. ..... 229/117.19
4,685,583 A * 8/1987 Noon ..... 229/402
5,454,484 A * 10/1995 Chelossi ..... 220/738
5,868,310 A * 2/1999 Leszczyski ..... 229/402
6,032,826 A * 3/2000 Libit et al. ..... 220/738

* cited by examiner

*Primary Examiner*—Gary E. Elkins
(74) *Attorney, Agent, or Firm*—Salter & Michaelson

(57) ABSTRACT

A recyclable beverage container handle is disclosed, fabricated from sheet material, such as cardboard or any other recyclable or biodegradable material. The handle comprises a cylindrical portion for receiving a beverage container and an "A" shaped handle portion. Both of these portions are fabricated from the same single continuous sheet. A method of manufacturing the container handle includes handle members that are continuous with the cylindrical portion which wraps around the outer walls of a container held therein. Thus, the handle is uniquely rigid, providing the user with a sense of firmness. A person using the handle need not have direct contact with the beverage container held therein, thus increasing his or her comfort level. Disclosed herein is a method of manufacturing and compacting the handle for easy storage and access of the invention.

7 Claims, 6 Drawing Sheets

RECYCLABLE BEVERAGE CONTAINER HANDLE

FIELD OF THE INVENTION

The present invention relates to beverage cup insulators and cup holders and handles, and more particularly concerns a recyclable beverage container handle for disposable cups such as are used in various food retailing establishments.

BACKGROUND OF THE INVENTION

Retailers often provide consumers with some sort of insulating sleeve for the purpose of keeping one's hand free from excessive heat dispersing from a liquid beverage in a plain, disposable cup. Likewise, a customer purchasing a cup of coffee or tea may be served the beverage in a ceramic cup or mug if the beverage is to be consumed in the business establishment itself.

Ceramic drinking vessels are desirable not only because they are firm and solid, but also because one can use the handle to insulate his or her hand from the heat of the cup, as well as having a secure grip. The novelty effect of a sturdy handle is not only desirable but also necessary when hot beverages are being held. However, ceramic cups are impractical since they need to be washed, and prepared to be re-used. The impracticality is seen especially when take-out food is the order of the day. Paper cups with foldout handles too have never proved sturdy enough to support the weight of a cup filled with a beverage. Disposable cups with an insulating sleeve are somewhat limiting in that the consumer cannot enjoy the practical use of a handle and it's novel effect, being that the person must hold the beverage directly in the palm of the hand. This is undesirable to many and somewhat crude in various cultures.

Overall, there have been numerous attempts to fabricate a sufficiently sturdy, disposable cup with handles, and even fewer attempts to make a holder or handle, which is actually not already part of a cup. Past examples of handles co-constucted along with a paper cup are as follows; U.S. Pat. Nos. 2,060,781; 2,287,644; 2,378,750; 2,558,287; 2,560,927; 2,659,527; and 2,867,365.

The differences in all of these above patents, while all functional, are generally limited to methods of erecting the handles and varying shapes of handles displayed. There is always some laborious task involved. Also, the preceding handles are all flexible in construction, resulting in a lack of much needed rigidity. The present invention uses a unique construction for sufficient strength, which is not found among past inventions. Secondly, all aforementioned handles require some sort of assembling,—some more than others do. Thirdly, there is another common flaw not shared with the present invention. That flaw being that most all attempt to securely support the weight of a full cup coffee or tea with 2 separate handles which are arranged closer to each other rather than closer to the opposite sides of the cup. The present invention employs something new in the art, which is the latter construction of the handles enwrapping the sides of the cup. They begin at a common point extended away from the wall of the container held therein, are continuous with the entire embodiment, and interface with the outer walls of the container held therein, thus ensuring sufficient rigidity and support. The present invention does not try to copy the appearance of a real ceramic cup. At no time are the handle members perpendicular to the container held therein. More importantly, the present invention employs a superior support structure constructed to give maximum stability.

U.S. Pat. No. 2,454,906 is more unique in that there is a vertically disposed handle. However it also requires assembly, and its handle does not interface with the opposite outer walls of a container held therein, unlike the present invention.

U.S. Pat. No. 2,558,287 states that its handle members are joined to its cup at "circumferentially spaced apart points". However, the distance of this spacing is not enough so that the handle members actually interface with the walls of the held container, as the present invention does. As FIG. 13 of U.S. Pat. No. 2,558,287 illustrates, the handle members are actually perpendicular to its container's walls, as is the case with previous and later inventions of container handles.

Earlier examples of similar inventions of cup holders intended to be separate and not integral with a disposable cup are U.S. Pat. Nos. 1,866,805 and 1,985,375, Both of these have a flat, one-dimensional handle protruding perpendicular to the side of the cup which proves to have no integral strength when the holder is tilted toward one's mouth to sip the beverage therein. They also have no hole in which to pass one's finger. The handle of the present invention is truly 3-dimensional, encompassing the entire body of the container held therein.

Later examples include U.S. Pat. No. 3,104,788 intended to carry a pair of beverage cups and U.S. Pat. No. 4,685,583 which handle section is also consequently flat and one-dimensional, lacking a reinforced structural support and flexing at opposing points where it's handle is perpendicular to it's encircled container At the same time, this particular version (U.S. Pat. No. 4,685,583) employs no element to retain and thus secure a beverage container therein, thus the handle easily slides over the top of the container placed inside of it, making it impractical as well as unsafe. This latter U.S. Pat. No. 4,685,583 also uses plastic in fabrication. However, if it is improperly disposed of, environmental unfriendliness becomes an issue. The solution to this problem has been addressed by the present invention, since it is made of biodegradable and recyclable material.

Consequently, what can be learned from previous inventions is that all previous handles on containers which remain curved in their nested positions and which then protrude from and are integral to a cup or container, remain flexible to a large degree since they are all constructed of flexible sheet material to begin with and must be flexible in order to be integral to or folded against the side of a container. When unfolded and used a wobbling effect is produced which is unsuitable when handling a beverage, especially one that is extremely hot.

It can also be concluded that by simply doubling the thin material used in constructing paper cups to make an adequate handle is shortsighted. There is no substitute for a structure that is geometrically sound. The present invention has such a structure, which has not been available in previous inventions. Besides this, previous inventions have often proved to be too laborious in nature to utilize and tend to look nice in appearance rather than work well.

Additionally with the increasing awareness of the importance of preserving the environment, there is a need for an suitable, low-cost, disposable cup handle which can also give the consumer a choice of holding a beverage in the palm of one's hand, or enjoying the novelty of a firm and stable handle, while at the same time, one's hand in either case may remain insulated from the heat (or cold) of the container.

The present invention is unique in that it actually adds strength to the container it is placed on, and the container it is placed on reinforces the handle portion of the invention, thus making paper beverage containers safer to use.

Conclusively, what is needed in the art and has heretofore not been available is an environmentally friendly cup handle, which excels in stability, can be quickly and easily placed on a cup with no assembling needed, and may not only insulate a container from one's hand but also gives the consumer the option of using a stable and comfortable handle as well. The present invention satisfies this and other needs.

SUMMARY OF THE INVENTION

In accordance with one aspect of the present invention, a recyclable beverage cup handle is disclosed which comprises a generally planar sheet. The sheet is folded according to a specific arrangement to form a generally circular shape which includes an integral "A" shaped handle portion which interfaces with the beverage container to be held inside of the circular shape, or cavity portion, thus giving the entire invention additional rigidity when in use. The above mentioned handle permits a person to engage or hold a beverage container when container is snugly placed into the complete circular cavity. The handle cavity portion used to accept a disposable container or cup is narrower at the bottom than it is at the top in order to secure a safe and snug fit for the disposable container or cup, which is customarily also narrower at the bottom than the top.

The purpose of the present invention is so that a person drinking a beverage from a disposable container or cup does not have to hold the beverage in his or her palm but can have the choice of using a firm handle instead. The present invention is made from a low cost recyclable and biodegradable material to eliminate the possibility of polluting the environment while at the same time caters to the need for comfort and safety. When the fingers of one's hand are touching the beverage container there is more of a chance of injury since there could be a very hot liquid inside the container. The present invention greatly reduces the chance for accidents since the user's hand is away from the container when using the handle, just as is the case with a ceramic mug or cup. Additionally he/she has more control of the container, which is also strengthened to further increase safety when the present invention is being used.

Due to its structure, the present invention uses a minimal amount of material to deliver a maximum amount of strength. Since it is low cost and recyclable, it may be disposed of along with the container so there is no need of using ceramic cups and mugs, which need to be washed in order to be used again. This can be costly and uses excessive amounts of water to accomplish.

Therefore it is the general purpose of the present invention to provide the practicality and novelty features found in a ceramic cup or container by providing a uniquely rigid and comfortable container handle, which may be used on a disposable container. The handle is also recyclable and low cost and can be readily placed on a disposable cup or container when using a ceramic vessel is impractical or unnecessary.

In accordance with another aspect of the invention, a beverage container handle for a disposable container is disclosed which comprises a generally planar sheet, having a number of vertical margins which designate fold lines and a hole adjacent to a number of these said margins, which, once the handle is manufactured, can accommodate one or more fingers of a person's hand through said holes.

In accordance with an additional aspect of the present invention, a beverage container handle is disclosed formed from a predetermined pattern on said planar sheet, with a folding means, that is an arrangement of pre-determined folds. Said handle portion along with the cavity portion of the invention are formed from the combination of said holes, a disclosed number of vertical folds, and a disclosed number of permanent bonding points.

In accordance with a further aspect of the present invention, the inside surface of the handle comprises a set of opposing margins therein lying a vertical arrangement of surface scores which produce needed flexibility for the curvature of the cavity portion of said planar sheet. The above mentioned scoring arrangement is further detailed in claims.

In accordance with a further aspect of the present invention, the handle portion is disclosed, integral to, continuous with and extending from opposing walls of circular cavity portion of said container handle.

In accordance with another aspect of the present invention, a small portion of the said planar sheet between a designated pair of margins defined as the clutch extension element completes the conical embodiment and ensures a snug and secure fit for the placement of a typical disposable container or cup.

Accordingly, as to a further aspect of the present invention, a means of compacting or flattening a plurality of beverage cup handles is disclosed which is suitable for storage and easy access in a retail environment.

Perforations for finger holes are also disclosed, which said hole perforations are explicitly positioned so as to perfectly overlap and maintain a continuous opening to accommodate one or more fingers of a person's hand when said planar sheet is folded and bonded according to the said folding means described in the detailed description. This said process of folding and bonding is integral to and completes the construction of the invention described herein.

It should be understood that the above mentioned aspects of the present invention are general in detail and are meant to give one a general idea of how the container handle is made. Complete details are described further in the detailed description of a preferred embodiment. The present invention is also not limited in its application to the details of its construction or to the arrangement of its components set forth in the detailed description to follow.

It is therefore an object of the present invention to provide a safe, practical handle, which can be readily placed onto a disposable cup or container, thereby utilizing it's means of holding or handling such disposable cups or containers.

It is another object of the invention to provide the user with the option of grasping the handle with his/her palm and fingers around the outer walls of the cavity portion which is wrapped around the container, or using the integrated handle portion which may provide the user with a more comfortable and novel experience.

It is also another object of the invention to provide a quickly and easily installable and removable handle without the need for any laborious task of assembling whatsoever. The invention is simply placed on a container.

Still another object of the invention is to provide a low cost, recyclable and biodegradable handle in order to help keep the environment free of unnecessary or unsightly waste.

It is a further object of the invention to provide the consumer with an insulating cup handle which is of superior construction, resulting in a secure and rigid and desirable holder for a cup of coffee or the like in order to avoid accidents and subsequent injury to a person.

These together with other objects of the invention, along with various novel features integral to the claims are specified herein in further detail in the appended figures, as well as in the detailed description of a preferred embodiment.

DETAILED DESCIPTION OF A PREFERRED EMBODIMENT

By way of overview and introduction, the present invention is described in connection with a container handle made of recyclable material such as corrugated cardboard or other sheet material. Such handle is readily opened and placed on the beverage container with handle portion erect when dispensed to the consumer. This, in lien of a conventional insulating sleeve which has no handle at all.

Figure 1:
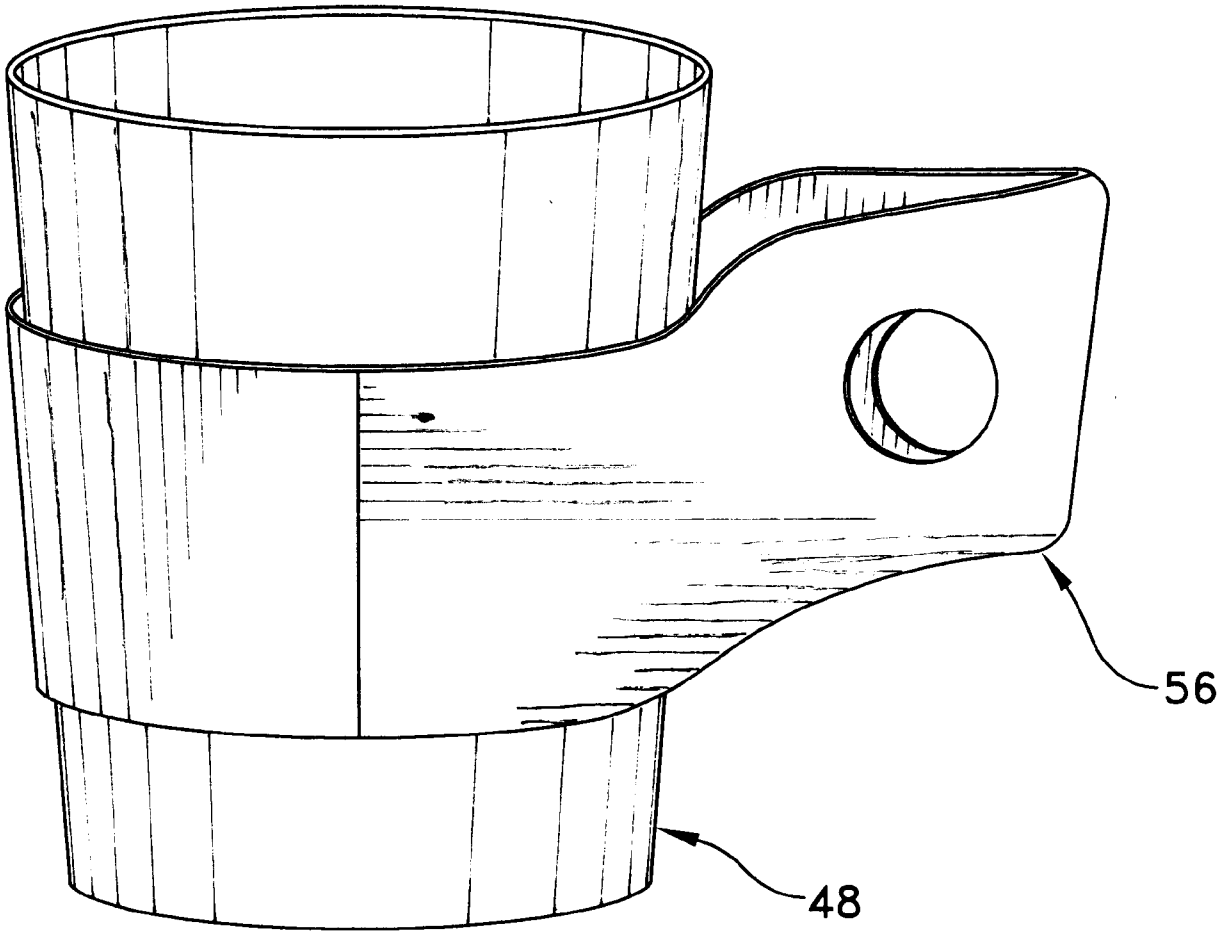
FIG. 1 illustrates the beverage container handle disposed around a container
Figure 2:
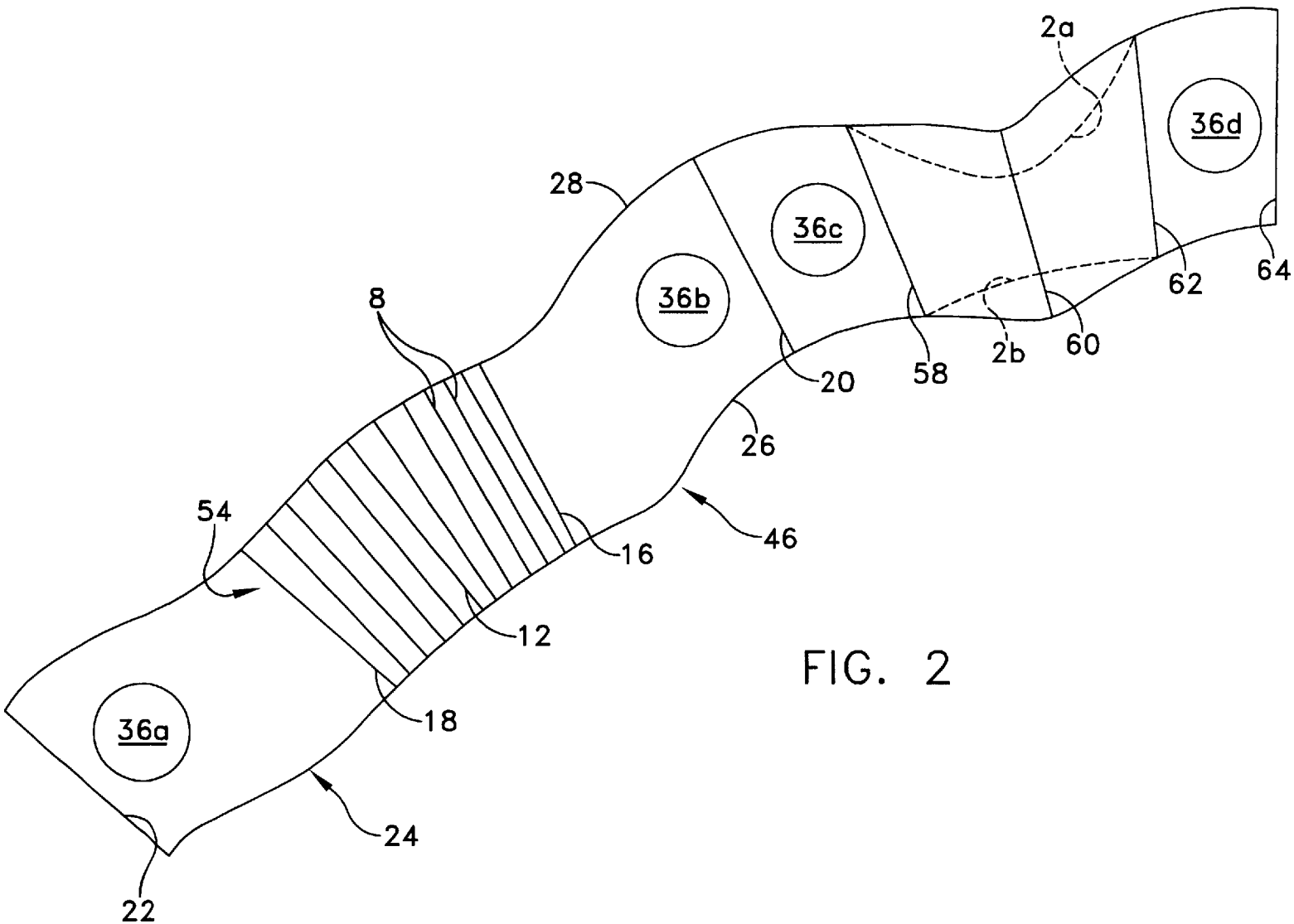
FIG. 2 illustrates the basic embodiment of the beverage container handle according to the present invention.

With reference now to FIGS. 1 and 2, a recyclable beverage container handle in accordance with the preferred embodiment is illustrated.

Figure 5A:
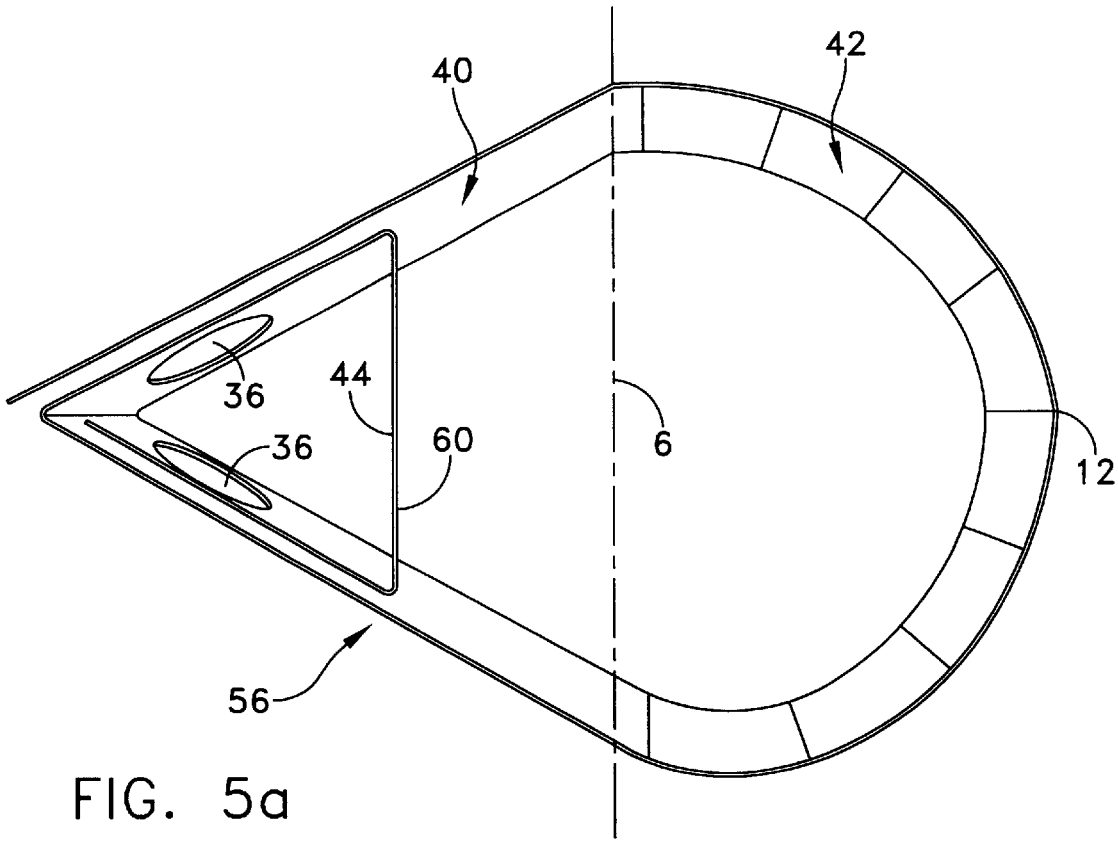
FIG. 5*a* illustrates a top plan view of the beverage container handle in its opened condition, ready to be placed onto a container.
Figure 5B:
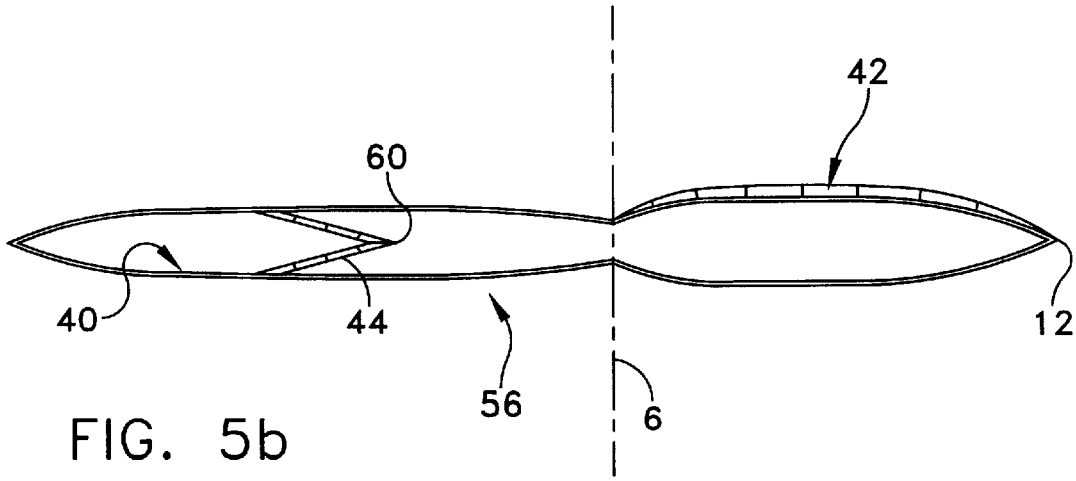
FIG. 5*b* illustrates a beverage container handle in a flattened condition suitable for storage in a retail environment.
Figure 6:
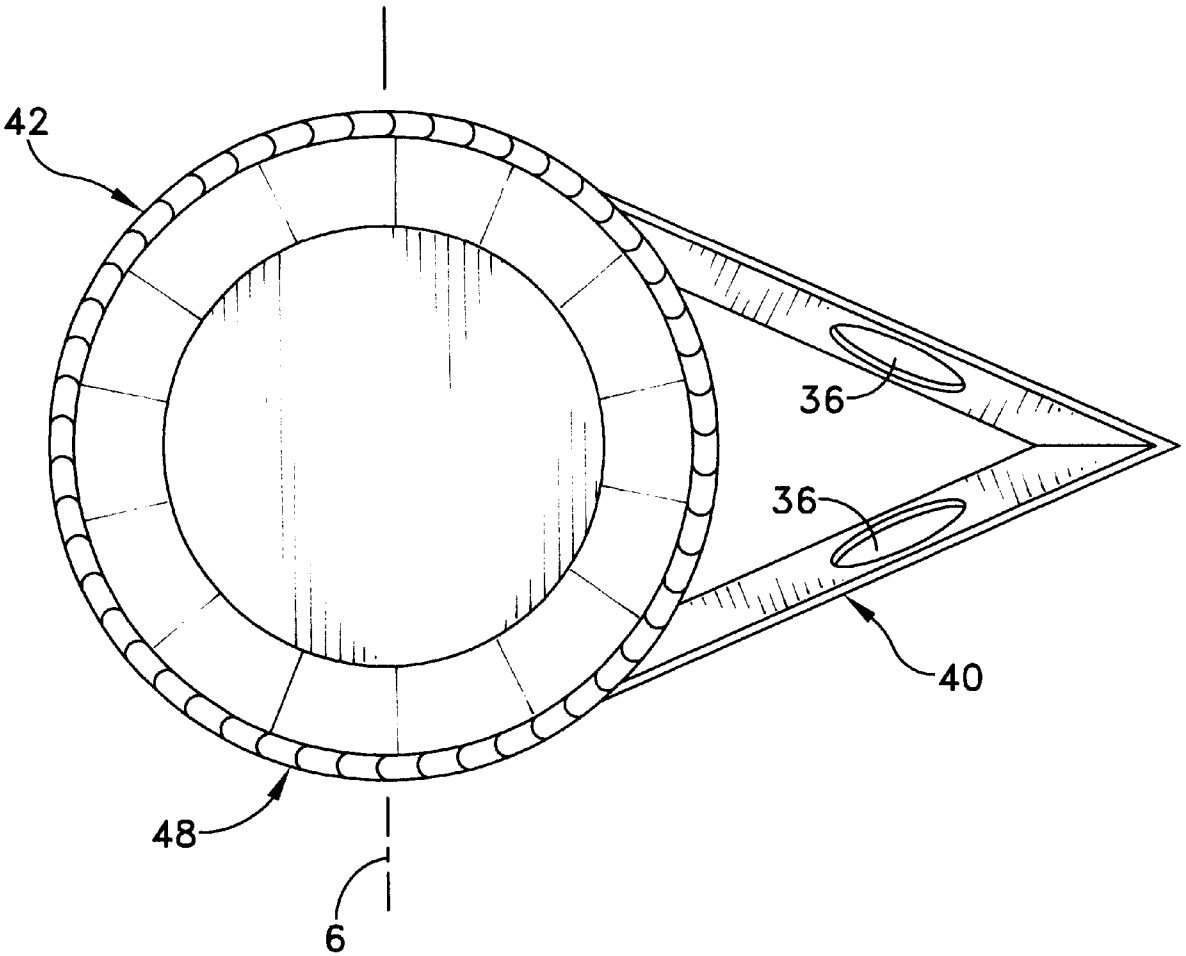
FIG. 6 illustrates a top plan view of the beverage container handle in place on a container.

The container handle 56 comprises a generally planar sheet 46 of material such as corrugated cardboard, but may use other sheet material as well. The handle 56 is exceptionally rigid in its construction with the exception of an achieved intermediate flexible portion, which is between a pair of opposing margins 16 and 18. The flexibility therein is attributed to a special arrangement of surface creases 8 between said pair of opposing margins 16 and 18, which said creases are needed when using the preferred material of corrugated cardboard. This flexibility allows for a snug fit around the outside curvature of a container 48 for at least one half or 180 degrees of the cavity portion 42, which is opposite the handle portion 40 of the invention. The handle portion 40 is seen in FIGS. 5*a* and 5*b* as it is the entire area to the left of a dividing line 6. The cavity portion 42 is also seen in FIGS. 5*a* and 5*b* as it is the entire area to the right of the dividing line 6. Handle elements are defined by the web portion located between margins 22 and 18 and the web portion located between margins 16 and 64, whence these two said portions are assembled as detailed further in the below description. Specifically, the area between margins 18 and 22 extends in converging relation to the area defined by margins 16 and 20 whereby margins 22 and 20 meet and form an apex, as shown most clearly in FIG. 1. The area defined by margins 20 and 58 is reversely bent from said apex and engages the inner surface of the area between margins 18 and 22 and is bonded thereto by any suitable adhesive means. The reversely bent portion merges into a strap member 44 (the area defined by margins 58 and 60) which extends laterally across the space between the web portions, as shown in FIG. 5*a*. Strap member 44 has an extension (the area defined by margins 62 and 64) which is folded to extend along the inner surface of area defined by margins 16 and 20 and is bonded thereto to complete the assembly. It will be noted that strap member 44 is located in close proximity to the adjacent surface of container 48 whereby said strap member 44 combines with said intermediate portion to snugly encircle substantially the entire circumference of container 48 to securely hold same while the handle is being held by a user. In this form of my invention the handle, along with strap 44, define an A-shaped configuration.

As illustrated in FIG. 2, the sheet or blank 46 has two sides, which define first and second broad surfaces 54 and 24, respectively. The sheet 46 includes holes 36*a*, 36*b*, 36*c*, and 36*d*, which are adjacent to margins 22, 20 toward margin 16, 20 toward margin 58, and adjacent to 64 respectively.

With reference to a folding means, a pair of opposing margins 64 and 22 define the length and the ends of the planar sheet. Another pair of opposing margins 26 and 28 define the width and the top and bottom of the planar sheet. In producing the preferred embodiment, fold line 60 is located at the center of strap member 44 and a fold line 12 is located at the center of the intermediate portion. This permits the handle 56 to be flattened, as illustrated in FIG. 5*b*, for convenience during storage and shipping.

After a series of surface scores 8 have been integrated between margins 16 and 18, as illustrated in FIG. 2, a permanent bonding agent is administered on side 24 between margins 20 and 58. A 180-degree fold is made along margin 12, folding it inwardly, allowing side 54 between margins 18 and 22 to be bonded to side 24 between margins 20 and 58 permanently. The sheet 46 area between margins 58 and 62 is the strap member 44 of the invention, and when the handle 56 is ready for use, this element 44 is crucial for securing a container held therein. The manufacturing process, being completed, leaves the container handle 56 in a compact, flattened state, and is easily opened and ready for use, as illustrated in FIGS. 5*a* and 5*b*. FIG. 1 illustrates this version of construction in place on the container.

Figure 3:
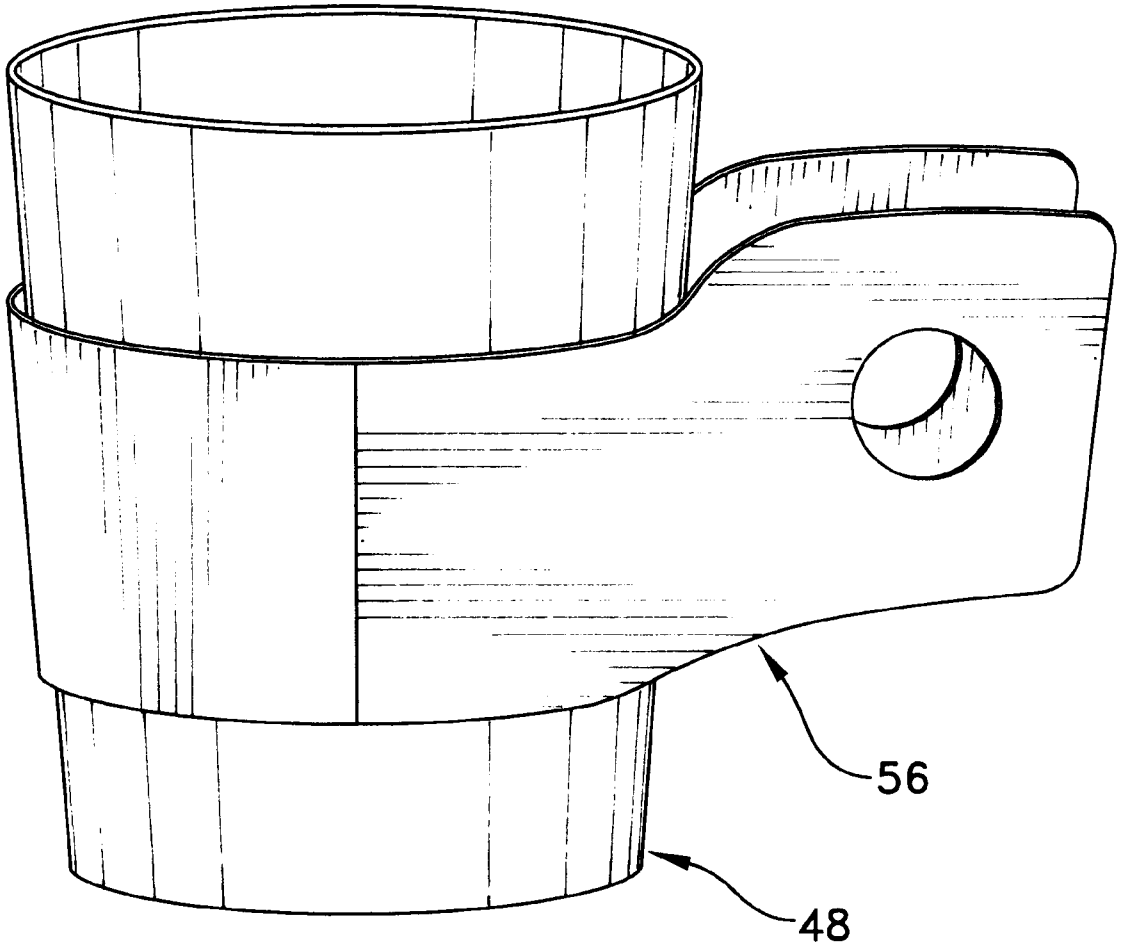
FIG. 3 illustrates the beverage container handle of FIG. 2 assembled in the alternate fashion and disposed around a container

In an alternate folding means and method of constructing said preferred embodiment, the sheet 46 has a fold along margin 60 so that the surface between margins 60 and 20 of side 24 abuts the surface between margins 60 and 64 of side 24. A permanent bonding agent is administered on the surface between margins 58 and 20 of side 54 and a 180 degree fold is made along margin 20 bonding said surface to the surface between margins 16 and 20 of side 54. Said bonding agent is then administered to the surface between margins 62 and 64 of side 54. A 180-degree fold is made along margin 12, folding it inwardly, allowing side 54 between margins 18 and 22 to be permanently bonded to side 54 between margins 62 an 64. FIG. 3 represents this alternate version of construction in place on the container where handle elements are still adjacent to the outer container walls, and continuous with the cavity portion 42. However the handle elements are not connected at their outer ends as in FIG. 1, but rather, along with strap 44, define an H-shaped configuration. This alternate folding means also produces a firm and strong handle, it being noted that in both forms of my invention the handle 56, and specifically the portions thereof which extend away from container 48, are of double wall thickness, thus providing added rigidity and strength.

The Recyclable Container Handle 56 remains rigid between opposing margins 18 and 22, margins 20 and 58, margins 62 and 64, and between margins 16 and 20 of the sheet. Therefore, an integrally sound and rigid handle 56 is produced as a result of the above aforementioned process. Such a handle is sufficient for safely holding or handling a beverage in a disposable cup, which in fact may be excessively hot. The container handle 56 may accommodate one or more fingers of a person's hand using finger holes 36 for a secure and comfortable fit.

Figure 4:
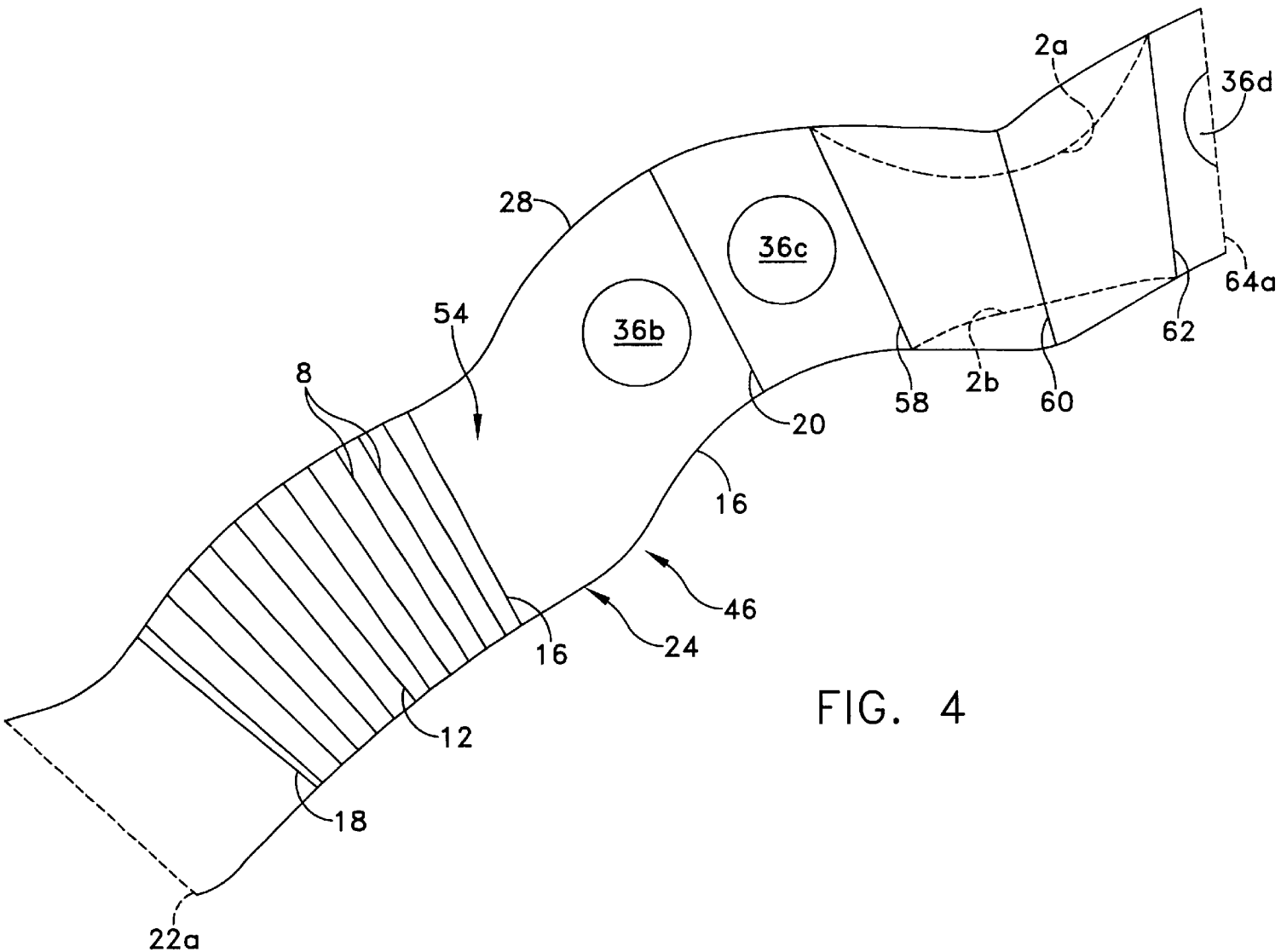
FIG. 4 illustrates an alternate version of the basic embodiment of the beverage container handle, which uses less material than FIG. 2.

With further reference to FIG. 1 the container 40 is clutched in the recyclable container handle 56 and is ready for use. As shown in FIGS. 2 and 4, the holder 56 can have a consistent width distance between longitudinal margins 26 and 28, having these two sides generally parallel to each other. Optionally, however as illustrated in FIGS. 2 and 4 by dotted lines 2*a* and 2*b*, opposing margins 26 and 28 may be constricted between margins 56 and 62, whereupon strap 44 may be narrower than the remainder of blank 46, which may be desirable for better engagement with the adjacent surface of container 48.

In accordance with another aspect of the invention, the handle 56 is arranged in a flattened condition as in FIG. 5*b*. A stack of container handles may be adjacent to other stacks of container handles, which together are preferably stored in a box until needed for use by the retail store, which is using them. Consequently, one or two container handles are taken from the top of the stack and readily placed onto a disposable cup containing a beverage for a customer.

As in FIG. 5*b*, an individual container handle 56 is compacted flat as it has been folded along margins 20, 60, and 12. FIG. 5*a* illustrates said folds of FIG. 5*b* in their unfolded positions accordingly as the handle is seen in its opened condition and ready to be placed around a container.

The handle portion 40 of the invention is seen as illustrated in FIG. 5*a* showing its continuity with the cavity portion 42. Together, these 2 portions form the complete structural embodiment of the present invention.

The recyclable container handle 56 according to the present invention is used to safely and comfortably hold a container, as illustrated in FIG. 1, which is filled with a beverage ready to consume.

The foregoing written description is of a preferred embodiment and particular features of the present invention is not restrictive of the many applications or the breadth of the present invention, which is instead defined by the claims appended hereto and substantial equivalents thereof.

I claim:

1. A recyclable unitary, one-piece handle for use with a slightly tapered cylindrical cup-shaped beverage container, comprising:

an elongated blank of flexible sheet material having an intermediate portion adapted to extend snugly around at least 180 degrees of the container circumference;

first and second web portions extending from opposite ends of said intermediate portion in substantially tangential relation to the container circumference;

at least one of said web portions having a reversely bent section merging into a strap member that extends across the space that exists between said web portions adjacent the surface of the container; and means securing said strap member to the interior surfaces of both web portions resulting in a doubling of the wall thickness of said web portions;

whereby said intermediate portion and said strap member combine to snugly encircle substantially the entire circumference of the container, and said double wall thickness of said web portions provide added rigidity and strength.

2. The handle of claim 1 wherein said web portions have aligned openings for receiving the finger of a user.

3. The handle of claim 1 wherein transverse score lines are provided adjacent the center of said intermediate portion and the center of said strap member for permitting said handle to be folded into a flattened condition for stacking and storage during non-use.

4. The handle of claim 1 wherein said web portions extend toward each other to form an apex so that, along with said strap member, they combine to define an A-shape configuration.

5. The handle of claim 1 wherein said web portions extend substantially parallel to each other so that, along with said strap member, they combine to define an H-shape configuration.

6. The handle of claim 4 wherein said reversely bent section extends along the inner surface of the other web member and is adhered thereto to form part of said securing means, said strap member at its other end having an extension that extends along the inner surface of said at least one web portion and is adhered thereto, thereby completing said securing means.

7. A recyclable unitary, one-piece handle for use with a slightly tapered cylindrical cup-shaped beverage container, comprising:

an elongated blank of flexible sheet material having an intermediate portion adapted to extend snugly around at least 180 degrees of the container circumference;

first and second web portions extending from opposite ends of said intermediate portion in substantially tangential relation to the container circumference;

said web portions converging to define an apex spaced from the container;

said web portions having aligned openings adjacent said apex for receiving the finger of a user to facilitate holding of the handle;

a strap member extending from one web portion to the other at a location adjacent to the surface of the container that is not engaged by said intermediate portion;

whereby said intermediate portion and said strap member combine to snugly encircle substantially the entire circumference of the container to provide secure holding of the container.

* * * * *